US007487746B2

(12) United States Patent
Rodenbeck et al.

(10) Patent No.: US 7,487,746 B2
(45) Date of Patent: Feb. 10, 2009

(54) ENGINE-DRIVEN TOOL

(75) Inventors: Jan Rodenbeck, Bornhöved (DE); Johannes Lugger, Hamburg (DE); Sascha Kolossow, Hamburg (DE); Dirk Spohr, Wedel (DE)

(73) Assignee: DOLMAR GmbH, Hamburg (DE)

( * ) Notice: Subject to any disclaimer, the term of this patent is extended or adjusted under 35 U.S.C. 154(b) by 0 days.

(21) Appl. No.: 11/847,130

(22) Filed: Aug. 29, 2007

(65) Prior Publication Data

US 2008/0127498 A1 Jun. 5, 2008

(30) Foreign Application Priority Data

Aug. 30, 2006 (DE) ..... 20 2006 013 282 U

(51) Int. Cl.
*F01P 1/00* (2006.01)

(52) U.S. Cl. ..... 123/41.56; 123/184.21

(58) Field of Classification Search ..... 123/41.01, 123/41.56, 184.21, 184.22
See application file for complete search history.

(56) References Cited

U.S. PATENT DOCUMENTS 3,477,238 A * 11/1969 Race ..... 62/3.61
6,145,484 A 11/2000 Funakoshi et al.

FOREIGN PATENT DOCUMENTS

DE 20102 026 U1 4/2001
DE 201 20 005 U1 4/2002

* cited by examiner

*Primary Examiner*—Noah Kamen
(74) *Attorney, Agent, or Firm*—Kelly Lowry & Kelley LLP

(57) ABSTRACT

A drive system for a tool, particularly a chain saw, includes a fresh air inlet and an intake manifold arranged after the fresh air inlet in the flow direction of the fresh air that opens into a carburettor. A combustion engine is provided that is arranged after the carburettor in the flow direction of an air-fuel mixture produced in the carburettor, in which the carburettor is exposed to a lower level of thermal stress. At least one heat conducting cooling vane is connected to the carburettor and protrudes outwards into direct contact with the ambient fresh air.

12 Claims, 3 Drawing Sheets

ENGINE-DRIVEN TOOL

TECHNICAL AREA

The invention relates to a drive system for a tool, particularly a chain saw, having a fresh air inlet and an aspiration chamber disposed after the fresh air inlet in the flow direction of the fresh air that opens into a carburettor, and a combustion engine that is disposed after the carburettor in the flow direction of an air-fuel mixture produced in the carburettor.

RELATED ART

According to the related art, drives for motorised chain saws may include a combustion engine and a carburettor arranged upstream thereof. While the combustion engine is running, a thermal equilibrium is created in the cylinder of the combustion engine. The heat that is generated by the combustion of the fuel-air mixture in the combustion chamber is dissipated in the hot exhaust gases, and the cylinder that surrounds the combustion chamber is also cooled by the fresh inflow of cooler fuel-air mixture. This equilibrium keeps the temperature of the cylinder constant. The equilibrium is upset as soon as the combustion engine is switched off. Not only is heat no longer removed in the escaping exhaust gases, but the cooling effect due to the inflow of the fuel-air mixture into the combustion chamber is also stopped. The brief, significant increase in the temperature of the cylinder is also transferred to the carburettor via the fuel-air mixture duct. As a consequence, the carburettor heats up. The heat that is generated in the carburettor places harmful stress on that component.

A multiple cylinder combustion engine having heat exchange surfaces on the outer wall of the air and fuel supply ducts is described in U.S. Pat. No. 4,256,093 A. Heat is absorbed from the hot exhaust duct through these and is used to preheat the flow as it enters the combustion chamber.

BRIEF DESCRIPTION OF THE INVENTION

Object, Solution, Advantages

The object of the present invention is to provide a drive system for a tool in which the carburettor is exposed to less thermal stress.

The object is solved by a drive system having the features of the main claim.

The drive system is designed for use with tools, particularly hand-guided tools, such as chain saws, angle grinders, hedge trimmers for example. The drive system has a fresh air inlet and an inlet manifold disposed after the fresh air inlet in the direction of the flow of fresh air. The manifold opens into an air intake of a carburettor. The drive system also includes a combustion engine, preferably a 4-stroke combustion engine provided after the carburettor in the flow direction. It is also conceivable to provide 2-stroke combustion engines. According to the invention, the drive system has at least one cooling vane that is connected in heat conducting manner to the carburettor, and protrudes outwards so as to come into contact with ambient fresh air. Particularly shortly after the combustion engine is switched off, additional heat is transferred from the cylinder surrounding the combustion chamber to the carburettor through an air-fuel mixture duct. This conventionally causes the carburettor to heat up considerably for a short time. The at least one cooling vane discharges heat particularly shortly after the drive system has been switched off, thus protecting the carburettor.

The at least one cooling vane preferably protrudes from an outer manifold wall of the manifold that is located between the carburettor and the at least one cooling vane. The manifold is preferably made entirely from a material that conducts heat exceptionally well.

The manifold may be delimited on the side facing the carburettor by an inner manifold wall that is in contact with the outer carburettor wall, and on the side facing away from the carburettor by an outer manifold wall furnished with at least one cooling vane. In this context, heat is removed from the carburettor via the contact surface with the inner manifold wall and via preferably two short lateral manifold walls and a manifold base to the outer manifold wall. From there, the heat is radiated via the at least one cooling vane. The at least one cooling vane may be added inexpensively with just a minor modification to the manifolds already in use.

In a further aspect of the invention, the intake manifold is furnished with an inlet for lubricant into the stream of fresh air. The drive system according to the invention includes an element for diverting a small fraction of the fuel after the carburettor in the flow direction of a fuel-air mixture. This small fraction of the fuel is fed into the lubrication circuit and used as a lubricant with the addition of oil. The drive system and other components as necessary are lubricated with the fuel-oil mixture. Accordingly, no further lubricants need to be added. After it has circulated through the entire lubrication circuit, the lubricant is returned for combustion. An inlet for the lubricant is provided in the intake manifold for this purpose. The fresh air flowing into the manifold takes up the lubricant that emerges there and transports it to the carburettor as air—with a small fraction of fuel. In the carburettor, a controllable quantity of additional fuel is added to the air and a fuel-air mixture is formed, which is then passed to the combustion engine for combustion.

The lubricant is heated as it passes through the lubrication circuit. In order to be able to discharge as much heat as possible from the lubricant into the fresh air via the at least one cooling vane of the invention, a thermally conductive lubricant duct that is in thermally conducting communication with the at least one cooling vane is provided before the inlet in the flow direction of the lubricant.

The lubricant duct preferably passes along the outer wall of the intake manifold. Particularly if the at least one cooling vane protrudes from the outer manifold wall, the thermally conductive connection between the lubricant duct and the cooling vane is exceptionally efficient.

The intake manifold may advantageously be assembled from several parts. The intake manifold may have an outer wall element arranged between a manifold component and an air filter component with the fresh air inlet, and an outer wall of the intake manifold component together with the outer wall element and an outer wall of the air filter component may form the outer wall of the intake manifold. The intake manifold component is furnished with an air duct preferably having an essentially elongated rectangular cross section extending across the direction of flow in cross section, and which is preferably delimited by the inner and the outer walls, and two lateral walls sloping from the inner to the outer walls of the intake manifold. The preferred multi-component construction of the intake manifold facilitates maintenance and access to the carburettor.

Multiple cooling vanes may be arranged parallel to each other particularly advantageously, in which case the cooling vanes lie flush with each other and are connected to each other at one end one by a transverse strip, and the other ends thereof are connected to each other by a U-shaped arch. The cooling vanes thus form a preferably single-part component that is correspondingly inexpensive to install.

The intake manifold is preferably made from light metal, particularly from aluminium. Aluminium is a particularly thermally conductive.

The drive system is preferably installed in a tool. In this case, the at least one cooling vane is arranged such that they are exposed to fresh air, or for example that openings in the tool housing allow direct contact between fresh air and the at least one cooling vane.

BRIEF DESCRIPTION OF THE DRAWING

The invention will be described with reference to an embodiment in three figures. The figures show, in diagrammatic form only.

BEST METHOD OF IMPLEMENTING THE INVENTION

Figure 1:
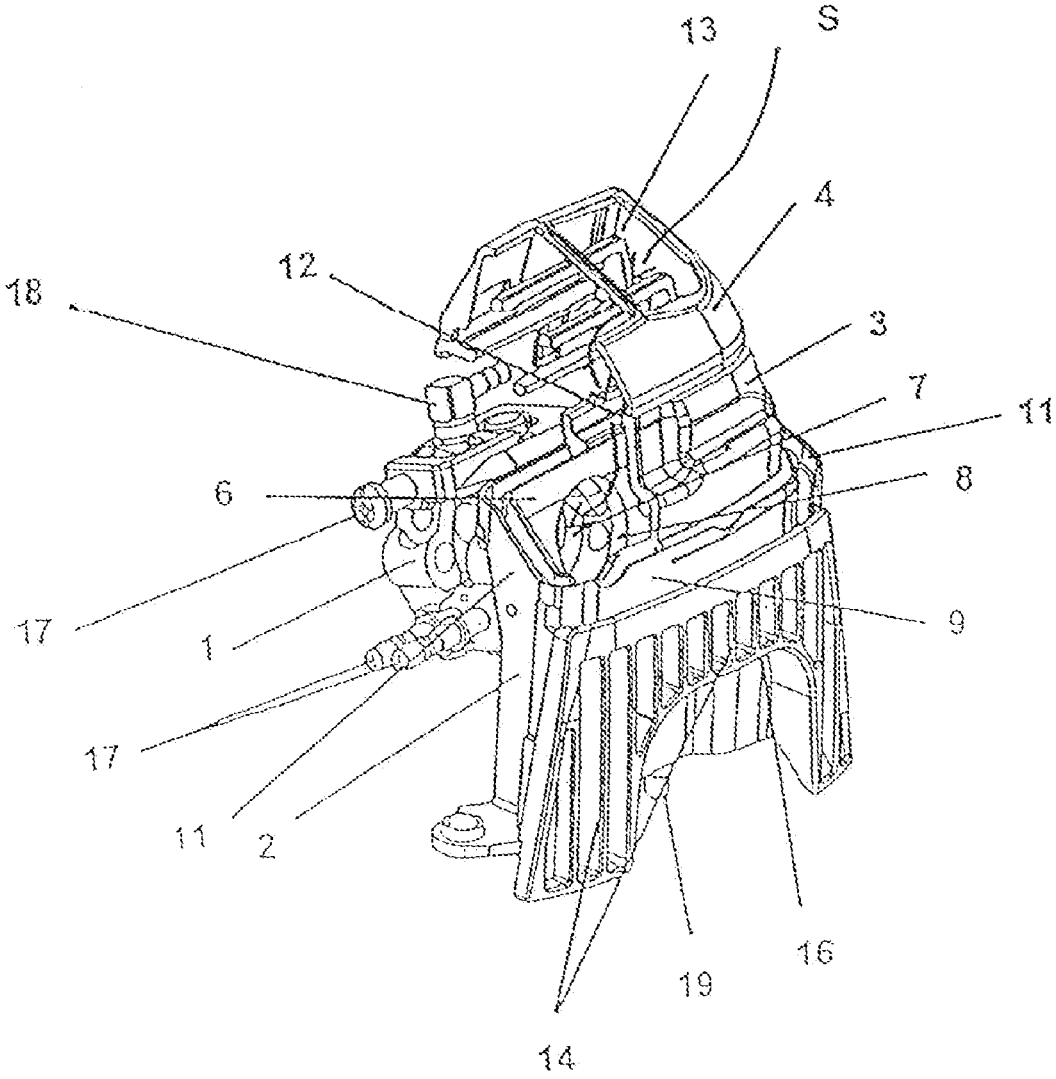
FIG. 1 a perspective view of a part of a drive system according to the invention, FIG. 2 a rear view of an intake manifold component, and FIG. 3 a front view of the intake manifold component of FIG. 2.

A carburettor 1 is shown partially concealed in FIG. 1. An intake manifold 2, 3, 4 includes a manifold component 2 and an outer wall element 2 inserted therein and an air filter component 4 engaged therein. An inner manifold component wall 6 of manifold component 2 is disposed so as to be in contact over a large area with the side of an outer carburettor wall. The contact surface between carburettor 1 and inner manifold component wall 6 is highly thermally conductive.

The wall of carburettor 1 facing manifold component 2 is furnished with an air inlet 7 for air that is supplied through intake manifold 2, 3, 4. The air that is supplied to carburettor 1 is already a mixture of fresh air originating from the ambient air with the addition of a small faction of a fuel-oil mixture. An aperture 8 is provided in inner wall 6 of manifold component 2 and is aligned with air inlet 7. Inner wall 6 and an outer wall 9 of manifold component 2 together with lateral manifold walls 11 standing perpendicularly thereto form a duct section, and they are constructed as a double wall at the upper, open edge. FIG. 1 shows the intended orientation of the components relative to each other and the ground during operation.

An edge of wall element 3 facing manifold component 2 is inserted in the double-walled edge of manifold component 2. An end of outer wall element 3 located opposite manifold component 3 is equipped with a latching mechanism 12. Latching mechanism 12 enables a free edge of air filter component 4 at the bottom to be engaged by a hook. Air filter component 4 is furnished with a fresh air inlet 13. An air filter (not illustrated) is provided in air filter component 4 downstream of fresh air inlet 13.

The fresh air is drawn in from the outside and flows through air inlet 13 of air filter component 4 through the air filter, along the inside of outer wall element 3 and into manifold component 2. Manifold component 2 is constructed with an essentially elongated rectangular cross section perpendicular to flow direction S of the fresh air. In manifold component 2, the fresh air is mixed with lubricant that is fed into manifold component 2 through an inlet—obscured in FIG. 1 by support 3. The fresh air with the addition of a small quantity of lubricant is then passed as air to carburettor 1.

The air flows into carburettor 1 through a throttle valve (not illustrated) along a venturi injector and collects a controllable quantity of fuel. The fuel-air mixture thus created flows out of carburettor 1 through of a fuel-air mixture outlet—obscured by carburettor 1—and into a fuel-air mixture inlet of the combustion engine (not illustrated). In this case, the combustion engine is designed as a 4-stroke engine.

Outer manifold component wall 9 of manifold component 2 is equipped with cooling vanes 14 disposed parallel to each other. Cooling vanes 14 are arranged vertically and are aligned essentially parallel to flow direction S. The upper ends of cooling vanes 14 facing air filter component 4 are flush with each other and are connected to each other by a heat conducting strip, while a heat conducting strip connecting the lower ends of cooling vanes 14 forms a U-shaped arch 16.

Three adjusting screws 17 are provided on carburettor 1. A connector 18 for the fuel pump is provided on the outside at the top of the carburettor wall. The end of manifold component 2 facing away from air filter component 4 is furnished with a connecting port 19 for a lubricant hose.

An element (not illustrated) for diverting a small quantity of fuel is provided between carburettor 1 and the combustion engine. About 3% of the fuel passing through the element is diverted. The diverted fuel is able to be introduced into the lubrication circuit and is used exclusively as lubricant. Thus, the drive system according to the invention does not require a separate supply of lubricant. The lubricant that is diverted via the diverting element in the form of fuel-oil is pumped into the lubrication circuit and at the end of the circuit is fed into manifold component 2 via connecting port 19, from where it is transported by the fresh air flowing past and introduced into carburettor 1 as air with a small fraction of fuel.

Figure 2:
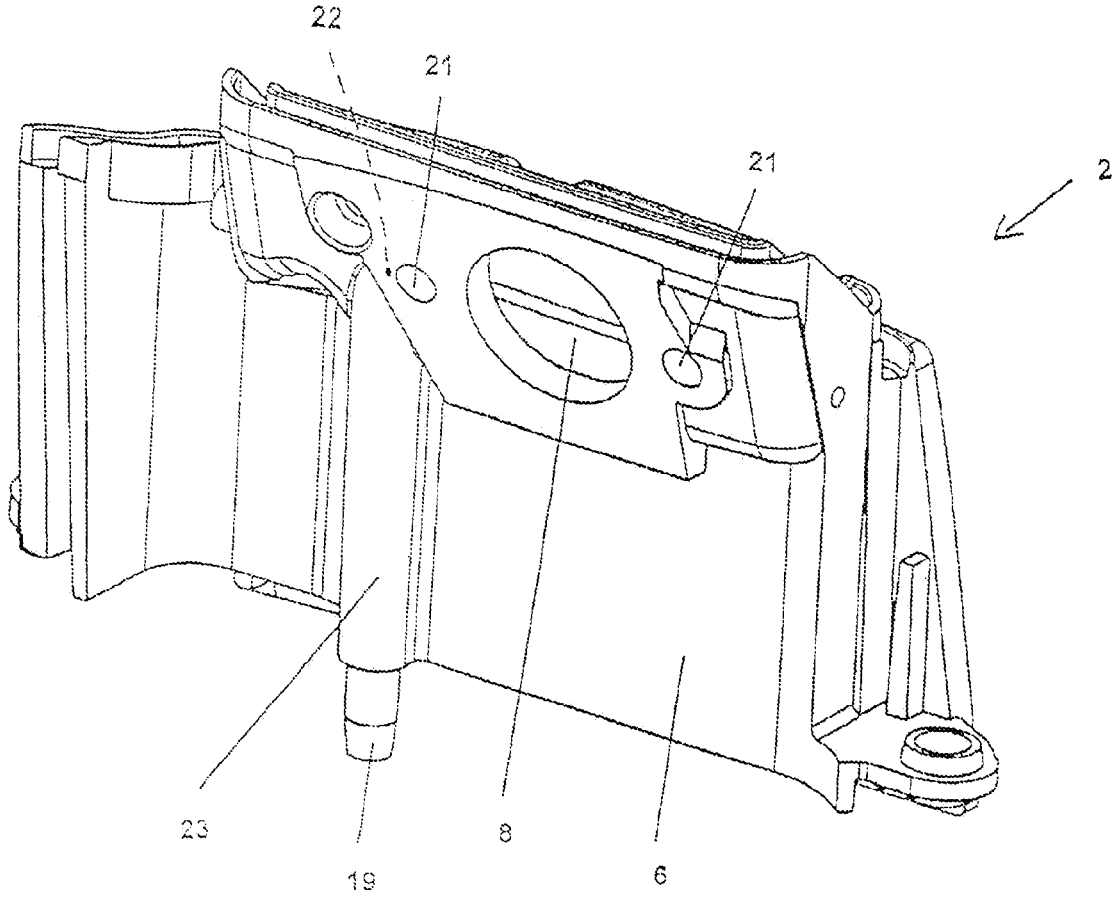

FIG. 2 shows a rear view of manifold component 2. The rear view is the view from carburettor 1. Manifold component 2 is furnished with aperture 8 that passes through inner wall 6 of the manifold component. Fixing holes 21 are also provided for screwing manifold component 2 to carburettor 1. Inner manifold wall 6 has a lubricant pipe 23 that opens into the air duct through an inlet 22. Connecting port 19 for the lubricant hose is provided at the end of lubricant tube 23 opposite inlet 22.

Figure 3:
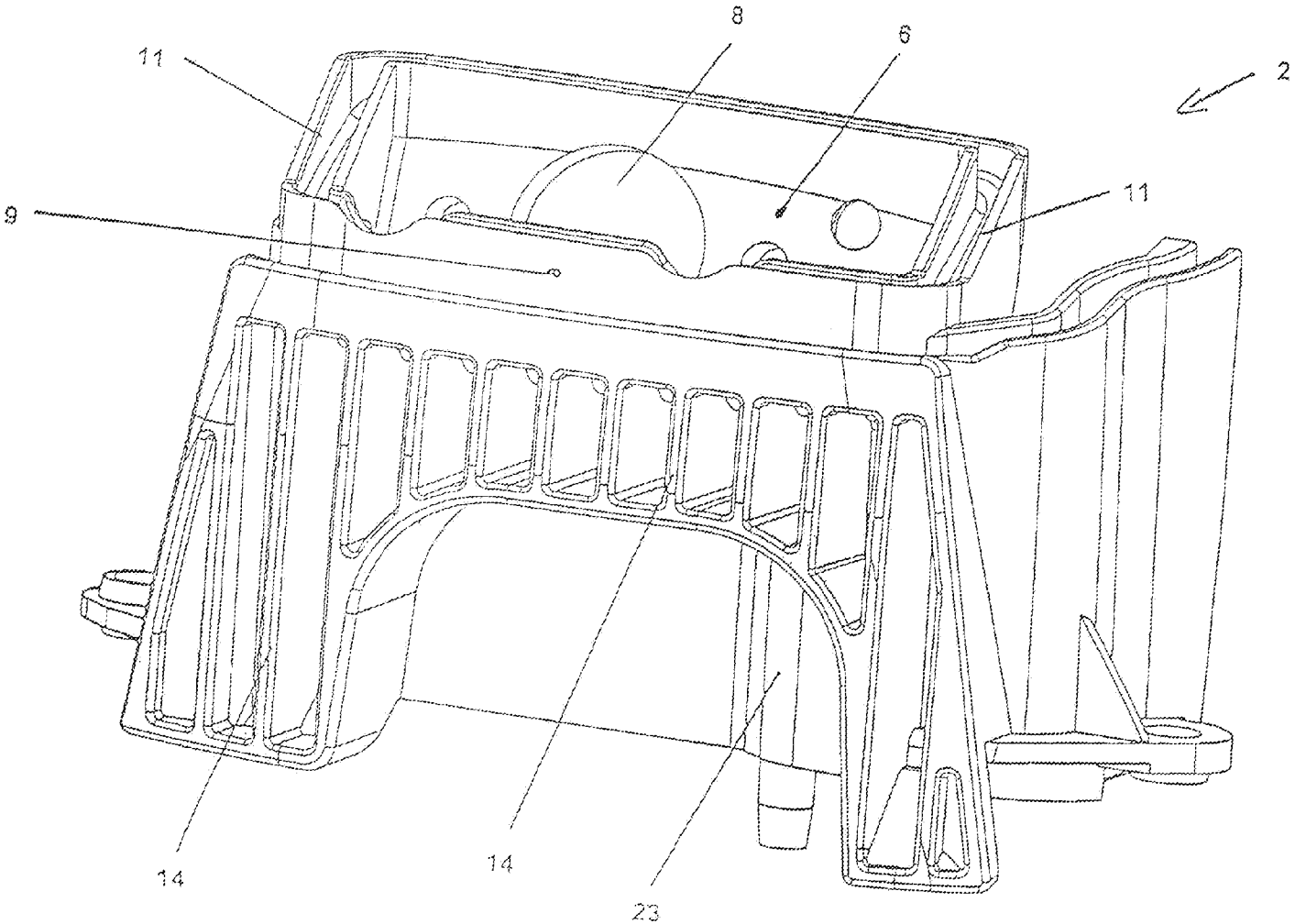

FIG. 3 shows the front view of intake manifold 2 of FIG. 2. About half of aperture 8 in inner manifold wall 6 is obscured by outer manifold wall 9. Inner and outer manifold walls 6, 9 together form two interface surfaces of the air duct of manifold component 2. The two lateral boundary walls are also formed by a double-edged lateral manifold wall 11. A plurality of interconnected, heat conducting cooling vanes 14 are provided on the outside of outer manifold wall 9. Cooling vanes 14 are also connected in thermally conductive manner to outer manifold wall 9.

Cooling vanes 14 not only radiate heat that is collected from carburettor 1. Cooling vanes 14 also radiate the heat that is transferred from the lubricant via lubrication pipe 23.

Particularly the cylinder of the combustion engine heats up considerably during operation. However, a thermal equilibrium is established in the cylinder during operation. The heat that is generated by combustion of the fuel-air mixture is balanced by the heat that is dissipated by discharge of the hot exhaust gas and the additional cooling effect of the cold fuel-air mixture flowing into the cylinder. This equilibrium is upset as soon as the combustion engine is switched off. The cylinder continues to heat up for a short while. This brief additional heating of the cylinder is caused by the fact that the dissipation of heat by the escaping exhaust gases suddenly ceases, and the introduction of the cool fuel-air mixture into the cylinder has also stopped suddenly. The heat radiated by the cylinder is transferred to the adjacent carburettor 1 particularly via a metal fuel-air mixture duct between the combustion engine and carburettor 1, and causes the carburettor to heat up considerably. The heat absorbed by carburettor 1 is dissipated directly into the ambient fresh air via the cooling vanes 14 according to the invention.

The drive device described in the above is part of the drive system of a tool, particularly a hand-guided tool such as a chain saw. Cooling vanes 14 are in direct contact with the fresh air surrounding the tool.

The lubrication circuit—not shown—starts at the diverter element (not shown) downstream of carburettor 1. The fuel passes through a non-return valve and along a lubrication line into the crank case. From there, it is agitated and pumped via a separate line by the underpressure or overpressure of the piston stroke into the cylinder head, where it lubricates valve flaps and other such components. At the same time, a second non-return valve ensures that the lubricant only flows in one direction. From the cylinder head, the lubricant passes into the control chamber of the crankshaft, and from here it is returned to intake manifold 2 via lubricant duct 23. In the course of its path through the lubrication circuit, the lubricant absorbs heat. At least some of this absorbed heat is discharged to the fresh air outside of the drive system in the area of lubricant duct 23 through the thermally conductive connection between lubricant duct 23 and cooling vanes 14.

LEGEND

1. Carburettor
2. Intake manifold component
3. Outer wall element
4. Air filter component
5. ---
6. Inner manifold component wall
7. Air inlet
8. Aperture
9. Outer manifold component wall
10. ----
11. Lateral manifold walls
12. Latching mechanism
13. Fresh air inlet
14. Cooling vanes
15. ----
16. U-shaped arch
17. Adjusting screws
18. Connector for fuel pump
19. Connection port
20. ----
21. Fixing hole
22. Inlet
23. Lubricant pipe
S Flow direction

The invention claimed is:

1. A drive system for a tool, comprising:
a fresh air inlet;
an intake manifold disposed after the fresh air inlet in a flow direction that opens into a carburettor;
a combustion engine disposed after the carburettor in the flow direction of an air-fuel mixture produced in the carburettor; and
at least one cooling vane connected in heat conducting manner to the carburettor and which protrudes outwards so as to come into contact with ambient fresh air;
characterized in that the intake manifold has an inner manifold wall that is in contact with an outer wall of the carburettor, and an outer manifold wall that is furnished with at least one cooling vane on the side thereof facing away from the carburettor.

2. The drive system as recited in claim 1, characterized in that the intake manifold has an inlet for introducing lubricant into the flow of fresh air.

3. The drive system as recited in claim 2, characterized in that a thermally conductive lubrication duct connected to the at least one cooling vane is provided on the intake manifold before the inlet in the flow direction of the lubricant.

4. The drive system as recited in claim 3, characterized in that the lubrication duct extends along the outer manifold wall.

5. The drive system as recited in claim 2, characterized in that the inlet forms an end section of a lubrication circuit.

6. The drive system as recited in claim 1, characterized in that the intake manifold is made from light metal.

7. A tool, particularly a motorised chain saw, having a drive system as recited in claim 1.

8. A drive system for a tool, comprising:
a fresh air inlet;
an intake manifold disposed after the fresh air inlet in a flow direction that opens into a carburettor;
a combustion engine disposed after the carburettor in the flow direction of an air-fuel mixture produced in the carburettor; and
at least one cooling vane connected in heat conducting manner to the carburettor and which protrudes outwards so as to come into contact with ambient fresh air;
characterized in that the intake manifold has an outer wall element arranged between a manifold component and an air filter component with the fresh air inlet, and an outer wall of the manifold component, the outer wall element and an outer wall of the air filter component form the outer wall of the intake manifold.

9. The drive system as recited in claim 8, characterized in that the inner manifold wall has an aperture that is aligned with an air inlet of the carburettor.

10. The drive system as recited in claim 8, characterized in that the manifold component has an air duct having an essentially elongated rectangular cross section extending transverse to the direction of flow in cross section, and which is delimited by the inner and outer walls, and two lateral manifold walls sloping from the inner to the outer walls of the intake manifold.

11. The drive system as recited in claim 10, characterized in that a wall edge encircling the air duct is constructed as a double wall and accommodates a edge of the outer wall that is at bottom during operation and has a latching mechanism that faces away from the bottom during operation for the air filter component.

12. A drive system for a tool, comprising:
a fresh air inlet;
an intake manifold disposed after the fresh air inlet in a flow direction that opens into a carburettor;
a combustion engine disposed after the carburettor in the flow direction of an air-fuel mixture produced in the carburettor; and
at least one cooling vane connected in heat conducting manner to the carburettor and which protrudes outwards so as to come into contact with ambient fresh air;
characterized in that multiple cooling vanes are arranged parallel to each other and at one end the cooling vanes are flush with each other and connected to each other by a transverse strip, and at the other the cooling vanes are connected to each other by a U-shaped arch.

* * * * *